US005588734A

United States Patent [19]

Talamo et al.

[11] Patent Number: 5,588,734

[45] Date of Patent: Dec. 31, 1996

[54] SIDE LIGHT FOR IN-LINE ROLLER SKATE

[76] Inventors: John A. Talamo, 131 Seafare, Laguna Niguel, Calif. 92677; Angela C. Hoy, 222 Prospect Ave., Newport Beach, Calif. 92663

[21] Appl. No.: 498,575

[22] Filed: Jul. 6, 1995

[51] Int. Cl.[6] ..... A63C 17/26

[52] U.S. Cl. ..... 362/61; 362/103; 362/191; 362/249; 280/811; 280/816; 280/11.22

[58] Field of Search ..... 362/103, 61, 78, 362/800, 253, 811, 35, 240, 249, 251, 252, 190, 191; 280/809, 811, 11.19, 816; 301/5.7, 5.3

[56] References Cited

U.S. PATENT DOCUMENTS

| | | | |
|---|---|---|---|
| 2,140,224 | 12/1938 | Galgoczy | 362/103 X |
| 2,502,566 | 4/1950 | Hooley | 362/103 |
| 2,531,959 | 11/1950 | Woodard et al. | 362/103 X |
| 4,240,132 | 12/1980 | Wickman | 362/103 |
| 4,463,412 | 7/1984 | Broach | 362/103 X |

OTHER PUBLICATIONS

"Inline Magazine", May 1995, pp. 19, 59.

*Primary Examiner*—Stephen F. Husar
*Assistant Examiner*—Thomas M. Sember
*Attorney, Agent, or Firm*—Roy A. Ekstrand

[57] ABSTRACT

A generally rectangular housing includes an elongated strap for attachment of the housing to the rear portion of an in-line skate. The housing supports a rearwardly directed lens and an internal battery power source for illuminating a plurality of rearwardly directed light elements. An elongated transparent tube supports a plurality of additional light elements and is operatively coupled to the power pack to provide illumination of the tube. A pair of clip fasteners are secured to the skate frame beneath the boot sole thereof to position the elongated tube in alignment with the in-line skate wheel arrangement. The transparent tube further supports a forwardly directed reflector and forwardly directed light element to provide frontal illumination ahead of the skate. Different color lenses are employed for the rearwardly directed light elements, the transparent tube, and the front light to provide directional and position information to an observer.

7 Claims, 1 Drawing Sheet

SIDE LIGHT FOR IN-LINE ROLLER SKATE

FIELD OF THE INVENTION

This invention relates generally to in-line roller skates and particularly to apparatus intended to increase the safe operation thereof during skating activities conducted at night.

BACKGROUND OF THE INVENTION

In-line roller skates have dramatically altered the nature and character of many roller skating activities. Such in-line skates have, in many instances, completely replaced the conventional four-wheeled rectangularly arranged roller skates. While the structure of such in-line skates varies substantially among manufacturers, all generally are fabricated using a pair of shoes or boots having undersurfaces supporting an elongated frame extending from beneath the toe to beneath the heel of the boot. Each frame supports a plurality of rolling wheels supported in a linear arrangement by high speed low friction bearing supports. Most in-line skates utilize four wheels per skate and substantial technology and energy is utilized in providing the most effective and efficient wheels and bearings to maximize speed. Breaking action is provided by a frictional engagement with the rolling surface usually in the form of a rear mounted break member supported at the heel of the skate behind the rearmost wheel. However, considerable effort has also been directed toward providing front mounted breaking mechanisms.

The combined result of this in-line configuration and the substantial technology applied to the wheel bearing and frame efficiency has been substantially greater speed and agility for skaters. However, this speed and agility has also increased the safety problems for both skaters and others situated near the skaters. The most prevalent problem for skaters themselves is the danger of a fall at high speed or when attempting difficult maneuvers. Some safety has been provided in the development of various protective gear such as helmets and various padded apparatus. Apart from protecting the skaters themselves from the dangers inherent in falling at high speeds, safety problems have arisen by virtue of the proximity of skaters to others due the skater's need to utilize flat hard surfaces such as sidewalks, strands, bike paths or other paved areas. The use of such areas by high speed skaters and pedestrians or cyclists often creates a high risk situation.

To exacerbate matters, many skaters utilize such crowded facilities at night either by preference or due to limited daylight hours being available. Skating at night in such areas increases safety problems due to the limited visibility available to all participants. For example, in darkened areas, individuals may be less capable of recognizing that persons approaching them from a darkened area may include skaters traveling at a substantial speed.

In attempting to reduce the safety problems created by night skating, practitioners in the art have provided reflective clothing for skater's use as well as battery-powered light packs which are attached to the skater's outer clothing or the skates themselves. One such attachable light pack for use on a skate is manufactured by Blade Beams, Inc., of Toronto, Canada. The light pack provided includes a molded plastic housing within which a battery power source and light mechanism is supported. The housing is secured to the skate by a support strap having a hook and loop fabric attachment. In use, the light pack is strapped to the rear of the skater's boot and secured by encircling the ankle with the support strap.

While the foregoing described prior art devices have provided some help, they have for the most part proven insufficient for reducing the hazards of night skating. For example, reflective clothing is of little effect unless illuminated by a light source. Thus, such reflective clothing has been found insufficient in darkened areas. The strap-on skate light packs of the type referred to above are operative to attract attention to a skater. However, such light packs are incapable of improving the skater's vision and generally do not provide information to the observer indicating the type of skater or direction of movement.

There remains therefore a need in the art for evermore improved safety apparatus for in-line roller skates operating at night.

SUMMARY OF THE INVENTION

Accordingly, it is a general object of the present invention to provide an improved safety apparatus for use on in-line skates in a night time environment. It is a more particular object of the present invention to provide an improved safety apparatus for night time operation of in-line skates which provides information to the observer as to the type of skate and the direction of skater movement. It is a still further object of the present invention to provide an improved safety apparatus for nighttime in-line skating which enhances the skater's vision.

In accordance with the present invention, there is provided for use in combination with an in-line skate having a foot-receiving portion, a frame beneath the foot-receiving portion, and a plurality of wheels supported by the frame, a side light comprising: a power unit having a housing defining an interior cavity, a rear lens, and an on/off switch; an attachment strap for securing the housing to the foot-receiving portion of the in-line skate; battery power means within the interior cavity coupled to the on/off switch; at least one rear light element supported by the housing and coupled to the power unit for illuminating the rear lens; an elongated tube defining a passage therein and formed of a light-transmissive material; a plurality of side light elements supported within the passage and coupled to the battery power means; and attachment means for attaching the elongated tube to the frame.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
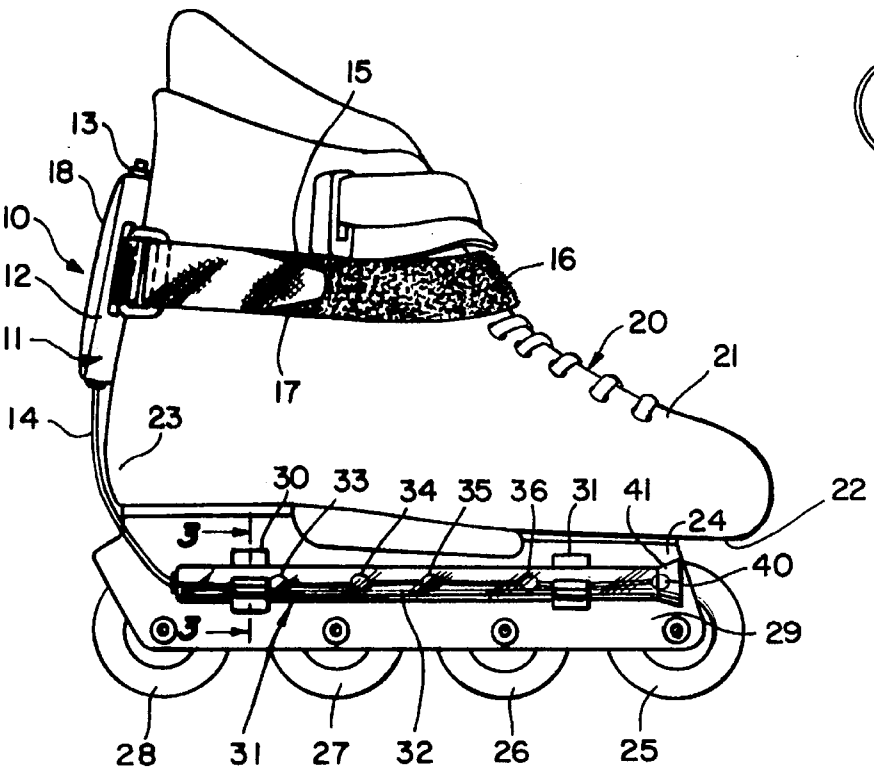
FIG. 1 sets forth a side elevation view of a typical in-line skate having the present invention side light secured thereto.

FIG. 1 sets forth a side elevation view of a side light for in-line roller skate constructed in accordance with the present invention and generally referenced by numeral 10. Light 10 is shown secured to a typical in-line skate generally referenced by numeral 20. Skate 20 is fabricated in accordance with conventional fabrication techniques and thus includes a foot-receiving boot 21 having a bottom sole surface 22 and a heel portion 23. In further accordance with conventional fabrication techniques, skate 20 includes a frame 24 secured to bottom sole 22 and supporting a plurality of rolling wheels 25, 26, 27 and 28 in an in-line configuration. Frame 24 further defines an outside surface 29.

In accordance with the present invention, light 10 includes a housing 12 secured to boot 21 by a strap 15 having fastener materials 16 and 17 formed thereon. While a variety of fasteners may be utilized to secure strap 15 to boot 21, it has been found convenient and advantageous to utilize a conventional hook and loop fabric attachment apparatus. Housing 12 supports a lens 18 on the rear surface thereof. In its preferred form, lens 18 is fabricated of a transparent plastic material preferably having a red tint. In addition, lens 18 is preferably fabricated in much the same manner as a conventional automotive taillight in that a plurality of internal and external facets are utilized to add strength and reflective character to lens 18. Housing 12 further supports a switch 13 and a plurality of downwardly extending wires forming a wire set 14. As is better seen in FIG. 4, housing 12 and lens 18 together with switch 13 and wire set 14 form a power unit 11 which as described below in greater detail produces operative power utilizing a plurality of internally supported batteries.

Light 10 further includes an elongated hollow transparent tube 32 having an interior passage 37 (seen in FIG. 3) which receives the end portion of wire set 14 and which supports a plurality of light elements 33, 34, 35 and 36 in a linear arrangement within transparent tube 32. The end portion of transparent tube 32 further supports a reflector 41 preferably having a focusing lens supported therein. A front light 40 having a forwardly directed light pattern is supported within the frontal end of transparent tube 32 and reflector 41. A pair of attachment clips 30 and 31 are secured to outer surface 29 of frame 24 using conventional adhesive attachment or its equivalent (not shown). Clips 30 and 31 may be fabricated in a variety of shapes and configurations, with the essential feature thereof being the capability of receiving and supporting transparent tube 32 against outside surface 29 beneath sole 22 in the manner shown in FIG. 1.

Transparent tube 32 is preferably fabricated of a transparent plastic material or its equivalent and may be clear or tinted as desired. Alternatively, transparent tube 32 may be fabricated of a frosted or translucent material to provide an alternative appearance to that provided by a transparent tube. The essential feature of transparent tube 32 is to permit light produced by lights 33 through 36 to permeate outwardly from tube 32 beneath sole 22 and thereby present an elongated highly visible light pattern which moves in accordance with the movement of in-line skate 20. In addition, front light 40 is forwardly directed and with the assistance of a lens 42 (seen in FIG. 2) produces a forwardly directed extending light pattern which indicates the frontal portion of in-line skate 20 and which provides a light pattern illuminating the skater's path and aiding the skater.

In operation, the user simply attaches light 10 to in-line skate 20 using strap 15 in the manner shown and positioning transparent tube 32 against clips 30 and 31. Thereafter, as is better seen in FIG. 3, clips 30 and 31 are opened by flexing in the manner shown to receive transparent tube 32 in a snap-fit attachment. Once light 10 is secured to skate 20, the user simply presses switch 13 activating power circuit 70 (seen in FIG. 4). The operation of power circuit 70 is described below in greater detail, however, suffice it to note here that activation of switch 13 applies electrical power via wire set 14 to lights 33 through 36 and front light 40. The result is illumination of transparent tube 32 and the production of a forwardly directed light from reflector 41. In addition and as is also better seen in FIG. 4, power unit 11 includes a plurality of rearwardly directed lights 72 and 73 with housing 12 which are concurrently activated in response to switch 13. The light produced by lights 72 and 73 is directed rearwardly by lens 18 producing a rearwardly directed light. In the preferred operation of the present invention, lens 18, transparent tube 32, and lens 42 are tinted differently to permit the distinguishing of the viewer's relationship to in-line skate 20. Thus, for example, with lens 18 tinted red, transparent tube 32 tinted amber or yellow, and lens 42 being clear, the observer is able to recognize the direction from which a skater utilizing skate 20 is approaching, receding or traveling in parallel. More specifically, observing red light emanating from lens 18 indicates to the observer that the skater is being approached from the rear while observation of yellow or amber light indicates a side approach. Finally, observation of a clear or white light indicates a directly approaching skater. In addition, the movement of skate 20 in terms of turning or otherwise changing direction may be observed due to the elongated light pattern of transparent tube 32. It will be recognized by those skilled in the art that lens 42 within reflector 41 is a matter of design choice and may be eliminated without departing from the spirit and scope of the present invention. It will be further recognized that a different selection of light colors within the elements of side light 10 may be utilized without departing from the spirit and scope of the present invention.

It will be apparent to those skilled in the art that the present invention side light communicates a substantial amount of information to the observer very quickly as to the skater's position, type of movement, and relative movement or relative direction with respect to the observer. This provides a greatly superior safety apparatus when compared to the above-described conventional light pack or other similar apparatus which simply provides a steady or blinking light observable from one direction. It should also be noted that the position of transparent tube 32 and front light 40 beneath sole 22 against outside surface 29 of frame 24 provides the present invention light apparatus without impeding the skater's ability to perform various skating patterns such as crossover steps in turns and the like. Thus, a virtually nonexistent intrusion into the skater's capability is created despite the substantial safety factor provided by the present invention side light.

Figure 2:
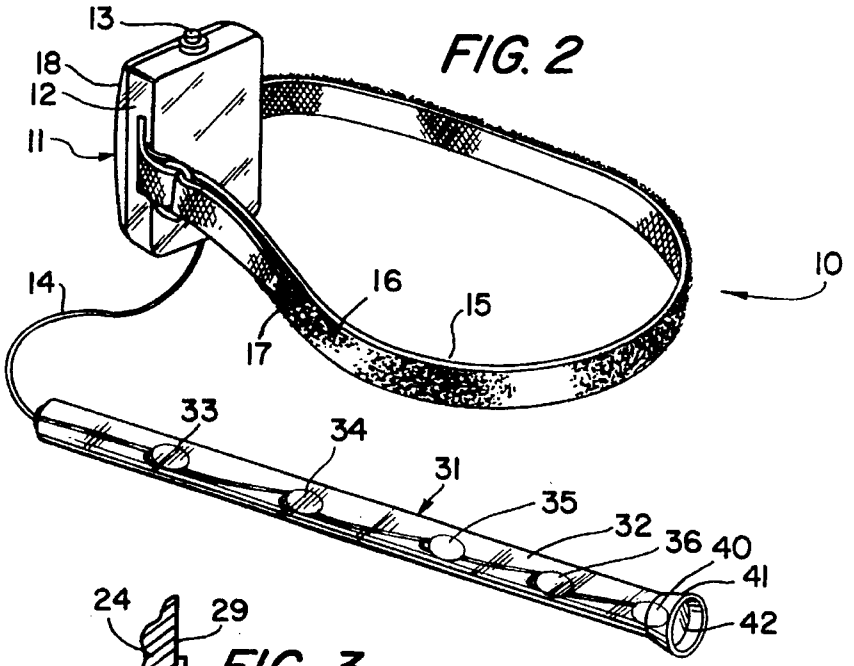
FIG. 2 sets forth a perspective view of the present invention side light for in-line roller skate.

FIG. 2 sets forth a perspective view of side light 10 separated from in-line skate 20 (seen in FIG. 1). As described above, side light 10 includes a power unit 11 having a housing 12 supporting a rearwardly directed lens 18 and an on/off switch 13. An elongated strap 15 is secured to housing 12 using conventional fabrication techniques and includes a pair of hook and loop fastening portions 16 and 17. An elongated hollow transparent tube 32 defines an interior passage 37 (seen in FIG. 3) within which a plurality of light elements 33, 34, 35 and 36 together with a front light 40 are supported. A plurality of electrical conductors forming a wire set 14 is coupled between power unit 11 and light elements 33 through 36 and front light 40. Transparent tube 32 further supports a reflector 41 having a lens 42 supported therein. Wire set 14 is appropriately conducted to light elements 33 through 36 and front light 40 in accordance with conventional fabrication techniques to provide energizing of light elements 33 through 36 and front light 40. It will be apparent to those skilled in the art that light elements 33 through 36 may be provided using conventional incandescent bulbs or, alternatively, may employ other light transducing apparatus such as light emitting diodes or the like. The essential feature of light elements 33 through 36 is the capability to convert electrical energy applied via wire set 14 from power unit 11 to visible light illuminating transparent tube 32 of side light assembly 31. Front light 40 may be fabricated differently from light elements 33 through 36 to provide a more extensive light output in order to illuminate the skater's forward vision. However, it will be apparent to those skilled in the art that a variety of light producing elements may be utilized for front light 40 such as a conventional incandescent bulb or the like.

Figure 3:
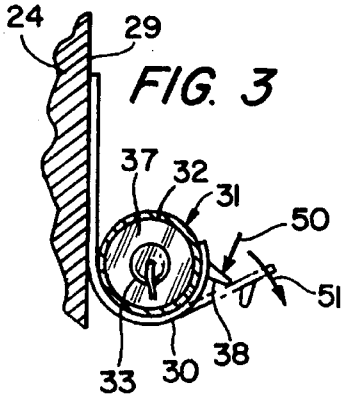
FIG. 3 sets forth a section view of the present invention side light for in-line roller skate taken along section lines 3—3 in FIG. 1.

FIG. 3 sets forth a partial section view of the present invention side light taken along section lines 3—3 in FIG. 1. As described above, in-line skate 20 (seen in FIG. 1) includes a frame 24 having an outer surface 29. A snap-action clip 30 is secured to surface 29 using conventional fabrication techniques such as adhesive attachment or the like. Clip 30 defines a circular portion formed of a resilient material and having an outwardly extending tab 38. Clip 30 is opened in response to pressure upon tab 38 in the direction indicated by arrow 50 causing the outer portion of clip 30 to flex outwardly in the manner indicated in dashed-line representation and in response to movement thereof in the direction indicated by arrow 51. Side light assembly 31 is secured to clip 30 by passing light tube 32 into the gap created in clip 30 and thereafter releasing tab 38 allowing clip 30 to encircle tube 32 and to secure side light assembly 31 to frame 24. As described above, transparent tube 32 defines an interior passage 37 which receives a plurality of light elements such as light element 33. While not shown in FIG. 3, it will be apparent to those skilled in the art that clip 31 functions in the identical manner to that described for clip 30 in securing the remaining portion of transparent tube 32 to frame 24 in the manner indicated in FIG. 1.

Figure 4:
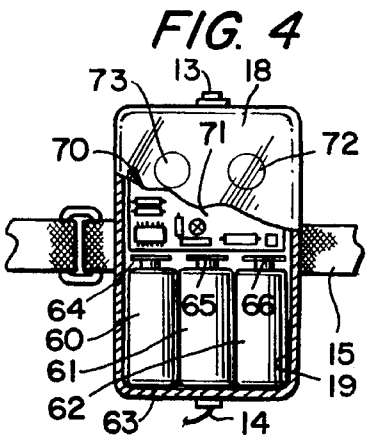
FIG. 4 sets forth a partial section view of the power pack portion of the present invention side light for in-line roller skate.

FIG. 4 sets forth a partial section view of power unit 11 constructed in accordance with the present invention. Power unit 11 includes a generally rectangular housing 12 supporting a lens 18 on the rear surface thereof. Housing 12 further defines an interior cavity 19 within which a plurality of conventional batteries 60, 61 and 62 together with appropriate connectors 63, 64, 65 and 66 are supported. Wire set 14 extends downwardly from the lower end of housing 12. Power unit 11 includes a power circuit 70 constructed in accordance with conventional fabrication techniques and providing a generally planar circuit board 71 upon which a plurality of conventional electronic circuit elements are supported. In addition, power unit 11 further includes a pair of light producing elements 72 and 73 supported upon circuit board 71 and operatively coupled to the electronic components of power circuit 70 in accordance with conventional fabrication techniques. While not seen in FIG. 4, it will be apparent to those skilled in the art that a plurality of appropriate electrical interconnections are provided between connectors 63 through 66 of batteries 60 through 62 and the circuit elements upon power circuit 70 as well as lights 72 and 73 and on/off switch 13 to provide operation of the present invention. Thus, power circuit 70 operates using the electrical power stored within batteries 60 through 62 to produce electrical energy applied to lights 72 and 73 as well as wire set 14. The electrical power applied to wire set 14 is utilized to energize lights elements 33 through 36 and front light 40 (seen in FIG. 1). It will be apparent to those skilled in the art that a variety of electrical circuits may be utilized to perform the function of power circuit 70 all of which are well within the recognized art. Thus, for example, power circuit 70 may provide steady energizing of light elements 72 and 73 together with light elements 33 through 36 and front light 40 (seen in FIG. 1) to provide constant illumination. Alternatively, power circuit 70 may utilize a blinking circuit or interrupter circuit to provide periodic blinking of the various light elements within the present invention side light.

What has been shown is a side light for in-line roller skates which provides important information to the observer and which greatly enhances the visibility of skaters in nighttime activity within darkened areas. The use of an elongated light pattern extending along the skate frame together with a rearwardly directed light of a different tint provides substantial information to the observer as to the skater's motion and direction as well as information as to the skater's relative attitude or direction. In addition, a forwardly directed front light preferably different in hue than the side or rear lights enhances the skater's vision into darkened areas and provides still more information to the observer. As a result, the observer is able to quickly ascertain the direction and approach attitude of a skater and take effective evasive action to avoid injury. In addition, the present invention side light is extremely helpful to prevent collisions between skaters in that skaters can immediately determine whether another skater is being approached by them or, alternatively, is traveling toward them in an approaching fashion. The use of an elongated side light illumination upon the in-line skates further enhances this capability to determine the type of motion or skating action being carried forward by the other skater. This, of course, greatly facilitates evasive maneuvering by skaters as they approach each other.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A side light for use in combination with an in-line skate having a foot-receiving portion, a frame beneath the foot-receiving portion, and a plurality of wheels supported by the frame, said side light comprising:

a power unit having a housing defining an interior cavity, a rear lens, and an on/off switch;

an attachment strap for securing said housing to the foot-receiving portion of the in-line skate;

battery power means within said interior cavity coupled to said on/off switch;

at least one rear light element supported by said housing and coupled to said power unit for illuminating said rear lens;

an elongated tube defining a passage therein and formed of a light-transmissive material;

a plurality of side light elements supported within said passage and coupled to said battery power means; and attachment means for attaching said elongated tube to the frame of the in-line skate.

2. A side light as set forth in claim 1 wherein said elongated tube defines a front end and front aperture and wherein said plurality of side light elements includes a front light element at said front end of said elongated tube producing a forwardly directed light beam extending through said front aperture.

3. A side light as set forth in claim 2 wherein said rear lens and said elongated tube are tinted with different colors.

4. A side light as set forth in claim 3 wherein said rear lens is red and said elongated tube is yellow.

5. A side light as set forth in claim 4 wherein said forwardly directed light beam from said front light is substantially free of color tinting.

6. A side light as set forth in claim 1 wherein said rear lens and said elongated tube are tinted with different colors.

7. A side light as set forth in claim 6 wherein said rear lens is red and said elongated tube is yellow.

* * * * *